US006718721B2

(12) United States Patent
Albany et al.

(10) Patent No.: US 6,718,721 B2
(45) Date of Patent: Apr. 13, 2004

(54) INSULATED BUILDING PANELS

(75) Inventors: Jason S. Albany, Yorba Linda, CA (US); Don J. Coulson, Fountain Valley, CA (US)

(73) Assignee: C-Thru Industries, Inc., Riverside, CA (US)

( * ) Notice: Subject to any disclaimer, the term of this patent is extended or adjusted under 35 U.S.C. 154(b) by 0 days.

(21) Appl. No.: 09/951,279

(22) Filed: Sep. 13, 2001

(65) Prior Publication Data

US 2003/0046892 A1 Mar. 13, 2003

(51) Int. Cl.[7] ..... E04B 2/00

(52) U.S. Cl. ..... 52/588.1; 52/581; 52/783.1; 52/792.11; 52/794.1; 52/796.1

(58) Field of Search ..... 52/588.1, 474, 52/506.01, 506.1, 578, 581, 782.1, 783.1, 630, 783.11, 787.1, 792.1, 792.11, 794.1, 796.1, 506.07, 506.08

(56) References Cited

U.S. PATENT DOCUMENTS

| | | | | | |
|---|---|---|---|---|---|
| 2,858,582 | A | | 11/1958 | Toulmin | |
| 3,386,218 | A | | 6/1968 | Scott | |
| 3,714,747 | A | * | 2/1973 | Curran | 52/588.1 |
| 3,742,672 | A | * | 7/1973 | Schaeufele | 52/594 |
| 3,760,548 | A | * | 9/1973 | Saur et al. | 52/593 |
| 3,854,260 | A | * | 12/1974 | O'Hanlon | 52/309 |
| 4,186,539 | A | * | 2/1980 | Harmon et al. | 52/588.1 |
| 4,373,312 | A | * | 2/1983 | Kim | 52/309.9 |
| 4,769,963 | A | * | 9/1988 | Meyerson | 52/309.9 |
| 4,998,396 | A | | 3/1991 | Palmersten | |
| 5,086,599 | A | * | 2/1992 | Meyerson | 52/309.9 |
| 5,092,095 | A | * | 3/1992 | Zadok et al. | 52/309.9 |
| 5,138,812 | A | * | 8/1992 | Palmersten | 52/584 |
| 5,293,728 | A | | 3/1994 | Christopher et al. | |
| 5,343,665 | A | * | 9/1994 | Palmersten | 52/588.1 |
| 5,348,778 | A | | 9/1994 | Knipp et al. | |
| 5,410,849 | A | | 5/1995 | Christopher | |
| 5,448,865 | A | * | 9/1995 | Palmersten | 52/309.9 |
| 5,502,939 | A | * | 4/1996 | Zadok et al. | 52/309.9 |
| 5,533,312 | A | * | 7/1996 | Mihalcheon | 52/309.9 |
| 5,613,338 | A | | 3/1997 | Esposito | |
| 5,664,386 | A | | 9/1997 | Palmersten | |
| 5,673,524 | A | | 10/1997 | Gailey | |
| 5,899,037 | A | * | 5/1999 | Josey | 52/267 |
| 5,950,389 | A | | 9/1999 | Porter | |
| 6,006,486 | A | * | 12/1999 | Moriau et al. | 52/589.1 |
| 6,122,879 | A | * | 9/2000 | Montes | 52/592.1 |
| 6,209,278 | B1 | * | 4/2001 | Tychsen | 52/592.4 |
| 6,216,409 | B1 | * | 4/2001 | Roy et al. | 52/589.1 |
| 6,311,454 | B1 | * | 11/2001 | Kempel | 52/784.15 |
| 6,314,701 | B1 | * | 11/2001 | Meyerson | 52/522.1 |
| D455,843 | S | * | 4/2002 | Albany et al. | D25/119 |

FOREIGN PATENT DOCUMENTS

| | | | | |
|---|---|---|---|---|
| DE | 42 42 530 | * | 6/1994 | 52/588.1 |
| GB | 2 243 381 | * | 10/1991 | 52/588.1 |

* cited by examiner

*Primary Examiner*—Carl D. Friedman
*Assistant Examiner*—Dennis L. Dorsey
(74) *Attorney, Agent, or Firm*—Tucker Ellis & West LLP

(57) ABSTRACT

A modular insulated building panel is disclosed. The panel is configured for connection to a like adjacently positioned insulated panel to form a building system. The panel comprises a central core of insulating material having two major surfaces and two side surfaces, substantially flat sheets on the major surfaces of the central core. Extending beyond the side surfaces of the core are male connectors having a generally convex curved first male mating member, a generally convex curved second male mating member, and a generally concave curved member between said first male mating member and said second male mating member. The panel further comprises female connectors having a generally concave curved first female mating member configured to accept the first male mating member, a generally concave curved second female mating member configured to accept the second male mating member, and a generally protruding member between the first female mating member and the second female mating member.

41 Claims, 3 Drawing Sheets

INSULATED BUILDING PANELS

FIELD OF THE INVENTION

The present invention pertains generally to the field of insulated building panels. More specifically, the present invention pertains to a new design for interlocking insulated building panels.

BACKGROUND OF THE INVENTION

Insulated building panels for modular construction of walls, ceilings, or the like are well known in the art. Such insulated panels are generally formed of two outer, thin-skinned metal layers of aluminum or steel having an internal, relatively thick insulating core. The concept of insulated panels has been known for many years and various types of connections have been used to connect such panels together. For example, connection was made in many such panels utilizing an additional support member, such as a cleat, to actually connect together mating edge-to-edge outer skin members of the panel in order to provide connection. In the past, efforts have been made to eliminate such cleats and to provide edge connections which are formed by the edge structure itself so that no additional cleat or other connecting member is required.

An example of such an insulated panel is found in U.S. Pat. No. 4,769,963 of Meyerson. One disadvantage of the panel member illustrated in the '963 patent is condensation caused by water settling on the bottom skin of the roof panel. In the situation where the panel members are connected together to form a ceiling for a room such as a patio enclosure, the upper, outer metallic skin becomes the roof and the bottom or inner metallic skin becomes the ceiling. Any leakage which travels from the top edge-to-edge connection to the bottom edge-to-edge connection actually lands and puddles on the very bottom metallic skin, which is the ceiling in the room. If the settled or accumulated liquid is cold (such as cold rain in winter) as compared to the temperature within the room, the cold liquid can cause the thin-skinned inside panel metallic skin to be reduced in temperature to the point that condensation forms on the outside of this bottom skin member (which is actually within the enclosed room). Of course, any condensation on the bottom skin member, which is the interior or ceiling side of the room, is extremely undesirable since the water may then drip onto furniture, carpet, etc. and cause the various problems caused by a leaky roof.

The utilization of the general concept of a male edge connector on a panel to be pressed into position in a groove, recess or valley in a female edge connector in a flush fit is known in the art. In one prior art device, U.S. Pat. No. 5,293,728 of Christopher et al., a panel is disclosed that attempted to overcome the problems discussed above by providing insulated roof panels which may be easily installed by pushing the panels together and may be easily be taken apart, and which will avoid leaking and condensation on the interior metallic skin. The '728 patent has a female connector with a V-shaped valley and a generally internally curved male connector configured to rest to the V-shaped valley of the female connector when two adjacent panels are connected. The panels in the '728 patent were designed to prevent or minimize leakage and condensation without use of caulking or other sealant. When connected, the male and female connectors form an elongated gutter or flow channel that is generally triangular. When the panels are horizontally positioned, rain water entering the top connection collects in the flow channel and flows outwardly to the exterior of the structure. Further, the design had secondary gutter for overflow if too much water collected in the flow channel.

While the design of the '728 patent was an improvement over some of the prior art, it had its disadvantages. One of the major problems with the '728 design is that the differences in shape between the female and male connectors create a "loose" fit when adjacent panels are joined together. The connectors of the '728 design can be manually manipulated to improve the fit once adjacent panels are joined together, but this manual manipulation is time consuming. It would therefore be preferable if adjacent panels were able to achieve a tight fit when connected while overcoming the problems of designs preceding the '728 design.

An alternative insulated panel design involves the use of splines for connecting one panel to another. Such panels are illustrated in U.S. Pat. No. 5,950,389 of Porter. Using splines eliminates the need for the construction of interlocking members at the sides of the panels. Also, the splines help prevent collection of water at the skin of the panel that acts as the ceiling when the panel is being used in roofing construction. However, as shown in the aforementioned patent, a panel system is provided having a panel joining arrangement for structural panels having opposed outer facings and an inner insulating foam core. The panel joining arrangement employs a pair of spaced metal splines, each bonded to the outer facings of adjacent panels and separated by an insulating core material. An adhesive may be applied to the spline prior to insertion in one of the slots.

One problem with spline systems is that they generally use adhesive. This makes the connection of panels a more permanent connection than that of interlocking members. Also, the use of adhesive increases the required time to create a panel system structure because it involves additional steps not required in an interlocking panel system. It would be preferable if there were provided a panel system having the benefits provided by the use of splines as well as those provided by the use of interlocking members, while eliminating the problems encountered by the two different panel types.

SUMMARY OF THE INVENTION

In accordance with the present invention, there is provided an insulated building panel configured for connection to a like adjacently positioned insulated panel to form a building system. The panel comprises a generally rectangular central core of insulating material having two major surfaces and two side surfaces, substantially flat sheets attached to the major surfaces of the central core. Integrally formed with one of the sheets at a side surface of the central core is a male connector. The male connector comprises a generally convex curved first male mating member, a generally convex curved second male mating member, and a generally concave curved member between the first male mating member and the second male mating member. Also integrally formed with one of the sheets at a side surface of the central core is a female connector. The female connector comprises a generally concave curved first female mating member configured to accept the first male mating member, a generally concave curved second female mating member configured to accept the second male mating member, and a generally protruding member between the first female mating member and the second female mating member.

Also in accordance with the present invention, there is provided an insulated building panel system comprising two insulated building panels adjacently positioned and connected together, each panel comprises a generally rectangular central core of insulating material having two major surfaces and two side surfaces, sheets attached to the major surfaces of the central core. Integrally formed with one of the sheets at a side surface of the central core is a male connector. The male connector comprises a generally convex curved first male mating member, a generally convex curved second male mating member, and a generally concave curved member between the first male mating member and the second male mating member. Also integrally formed with one of the sheets at a side member of the central core is a female connector. The female connector comprises a generally concave curved first female mating member configured to accept the first male mating member, a generally concave curved second female mating member configured to accept the second male mating member, and a generally protruding member between the first female mating member and the second female mating member.

DETAILED DESCRIPTION OF THE INVENTION

Figure 1:
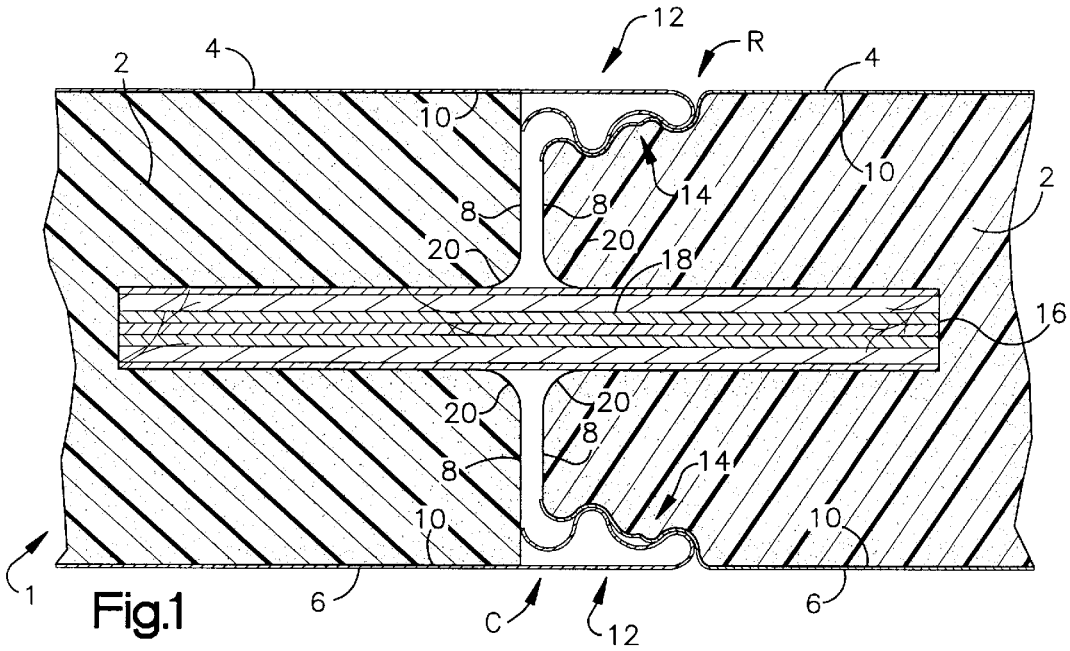
FIG. 1 is a perspective view of panels according to the present invention in adjacent position connected together.
Figure 2:
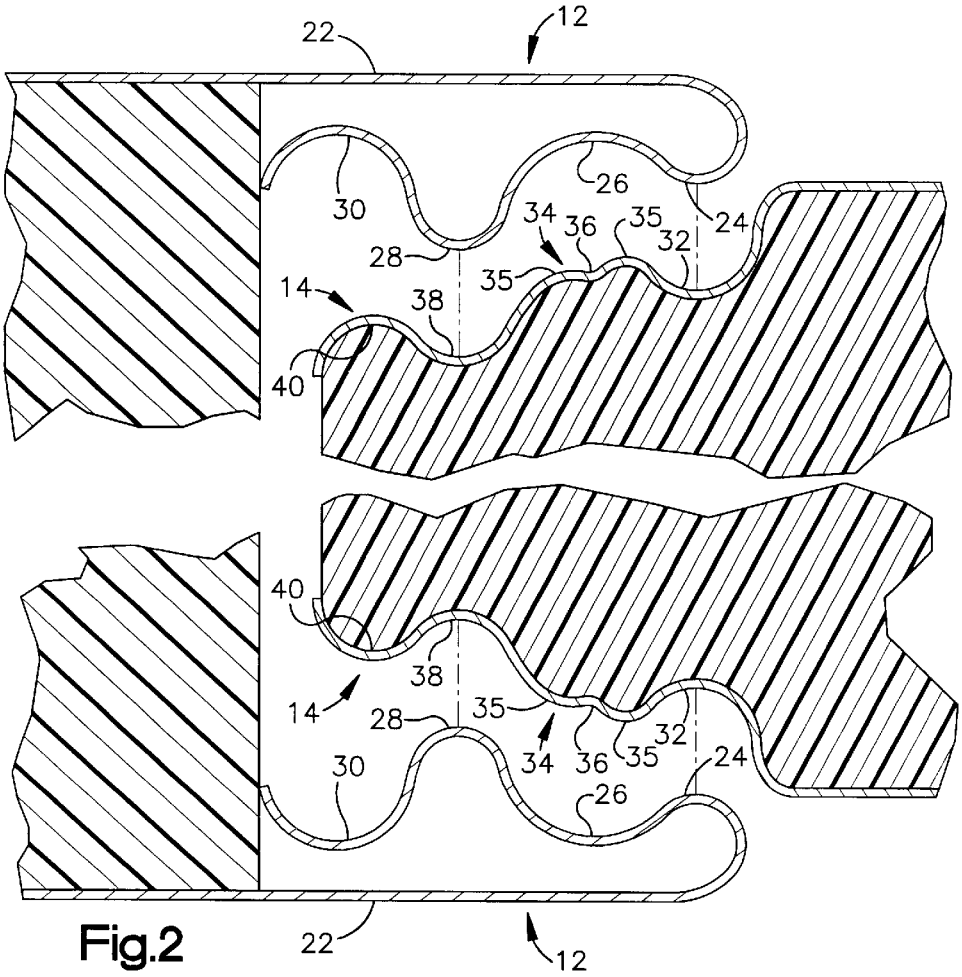
FIG. 2 is a magnified view of the male and female connectors of panels according to the present invention illustrating the connection mechanism of the male and female connectors.

Referring to FIGS. 1 and 2, the general structure of a panel 1 in accordance with the present invention will be described. Each panel 1 comprises a first outer-skinned sheet 4 and a second outer-skinned sheet 6 separated by an interior insulated core 8. Integrally formed with the sheets 4 and 6 are male and female connectors 12 and 14 respectively. In the presently preferred embodiment shown in FIGS. 1 and 2, one side of panel 1 terminates in male connectors 12 and the other side of panel 1 terminates in female connectors 14. Alternatively, each side of panel 1 could have both a male connector 12 and a female connector 14.

The core 8 is preferably constructed of any suitable insulating material. Such materials include expanded polystyrene, urethane, polyisocyanate, or the like. The core 2 is suitably preformed or foamed-in-place material as is known in the art. For example, a polystyrene core 2 may have a thickness (distance between sheets 4 and 6) of 3 inches and a density of 1.5 lbs. The core 2 is generally rectangular in shape, having two opposite major surfaces 10 to which sheets 4 and 6 are attached and two opposite reduced thickness side surfaces 8. The two side surfaces 8 are generally perpendicular to major surfaces 10. Preferably, the distance between the side surfaces 8 (the width of major surfaces 10) is less than the length of major surfaces 10.

Preferably, the side surfaces 8 have a slot 16 running generally parallel to major surfaces 10 and sheets 4 and 6. The slot 16 preferably has a generally rectangular shape and configured to accept a spline 18. Preferably, slot 16 and spline 18 run along the entire length of side surface 8. A spline 18 is suitably rectangular in shape and made from wood or metal. In a presently preferred embodiment, spline 18 is approximately one half inch thick plywood, however it is also contemplated that the spline 18 be made from metal such as aluminum, plastic, or other types of wood. The interface 20 between slot 16 and side surface 8 is configured so that the slot 16 widens or expands toward side surface 8. The expansion of slot 16 at surface 8 facilitates the placement of a spline 18 in slot 16. Preferably, interface 20 is rounded or curved.

Figure 5:
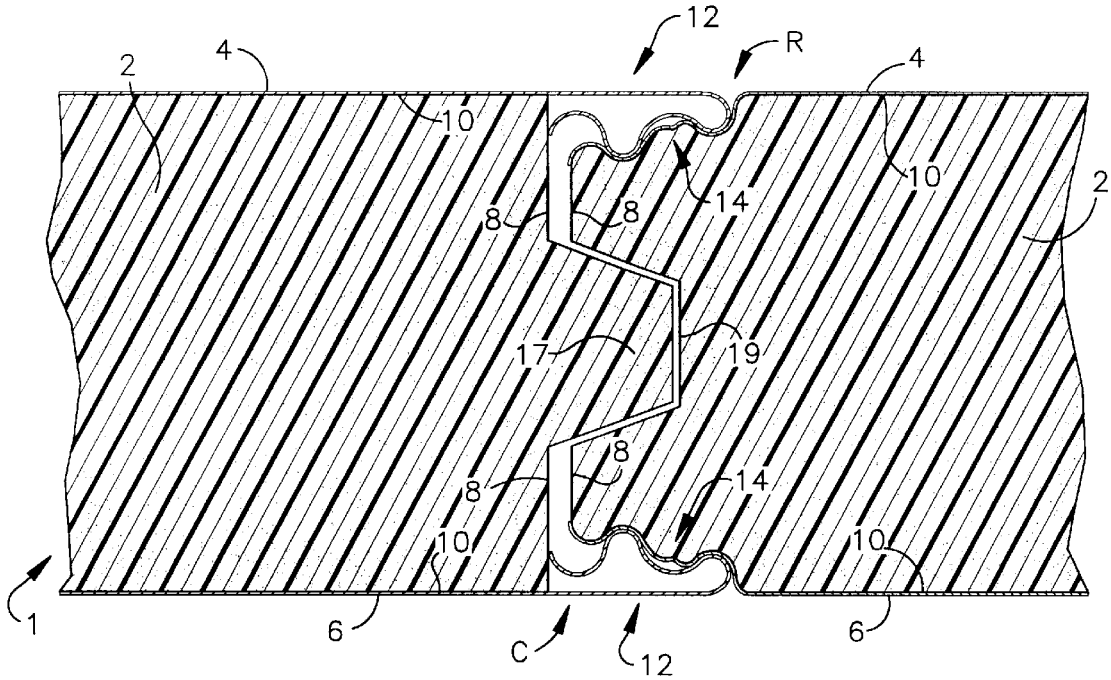
FIG. 5 is a perspective view of panels according to an alternate embodiment of the present invention in adjacent position connected together.

Alternatively, as shown in FIG. 5, core 2 has a tongue 17 extending externally from one side surface 8 and a groove 19 extending inward to the center of core 2 from an opposing side surface 8.

The sheets 4 and 6 are thin and preferably made from a flexible metal, which is suitably aluminum, steel, or other metals as are known in the art. Alternatively, sheets 4 and 6 are formed from a plastic or resin material as such materials are known in the art. Both sheets 4 and 6 are shaped to conform with and be attached to core 2. The sheets 4 and 6 are attached to core 2 by a suitable adhesive as is also known in the art. In a presently preferred embodiment, sheets 4 and 6 are attached to core 2 so that sheet 6 is a mirror image of sheet 4. The thickness of sheets 4 and 6 is generally small as compared to the thickness of core 2 where the thickness of core 2 is defined as the distance between the attached sheets 4 and 6. Preferably, the sheets 4 and 6 have a thickness between 0.01 and 0.15 inches, depending on the material used.

Integrally formed to sheets 4 and 6 and extending beyond the side surface 8 is at least one male connector 12. In a presently preferred embodiment, two male connectors 12 extend from sheets 4 and 6, beyond surface 8 as mirror images of the other. Each male connector 12 includes a substantially flat extension member 22 joined to an generally convex curved first male mating member 24 which preferably extends a distance from extension member 22 toward the center of core 2 when measured in a vertical plane. Connected to first male mating member is a generally concave curved member 26 which preferably extends in a direction generally opposite that of first male mating member 24, and away from the center of core 2. Connected to curved member 26 is a generally convex curved second male mating member 28 which preferably extends in the same general direction as first male mating member 24 and toward the center of core 2. Optionally, a suitably curved second male extension member 30 extends from second male mating member 28 toward side surface 8. Preferably, second extension member 30 contacts side surface 8. The combination of second extension member 30, second male mating member 28, curved member 26 and first male mating member 24 suitably forms a generally sinusoidal shape. Preferably, second male mating member 28 extends farther from sheet 4 or 6 and closer to the center of core 2 than does first male mating member 24.

Also integrally formed to sheets 4 and 6 and is at least one female connector 14. Preferably, the majority of female connector 14 is fixed to core 2 by a suitable adhesive. Furthermore, the core 2 is suitably shaped to match female connector 14, the core 2 terminating at a side surface 8. The female connector 14 comprises a generally concave curved first female mating member 32 extending from major surface 10 toward the center of core 2. Connected to the first female mating member 32 is a generally protruding member 34 extending in a direction generally opposite that of first female mating member 32, or generally away from the center of the central core 2. The generally protruding member 34 is suitably curved and extends further from the center of central core 2 than does first female mating member 32. In a presently preferred embodiment, the generally protruding member 34 comprises a channel 36 between the edges 35 of the generally protruding member 34. The channel 36 is suitably generally concave, extending in a direction generally opposite that of generally protruding member 34, or toward the center of central core 2. The channel 36 suitable acts as a flow channel for air or water. Preferably, at least one of the edges 35 mates with and contacts the surface of the concave curved male mating member 26. Connected to generally protruding member 34 is a generally concave second female mating member 38. Second female mating member 38 preferably extends in the same general direction as first female mating member 32, or toward the center of central core 2. Like first female mating member 32 and generally protruding member 34, second female mating member 38 is also preferably located between opposing side surfaces 8 of central core 2. In the presently preferred embodiment, second female mating member 38 extends farther from sheet 4 or 6 and closer to the center of core 2 than does first female mating member 32. Preferably, first female mating member 32, the generally protruding member 34 and the second female mating member 38 are located between opposing sides 8 of central core 2. Optionally, a preferably generally curved female extension member 40 extends from second female mating member 38 toward side surface 8. In a presently preferred embodiment, the female extension member 40 extends in a direction generally opposite that of second female mating member 38 and is curved in a generally convex manner, suitably terminating toward the center of central core 2 beyond side surface 8.

Figure 3:
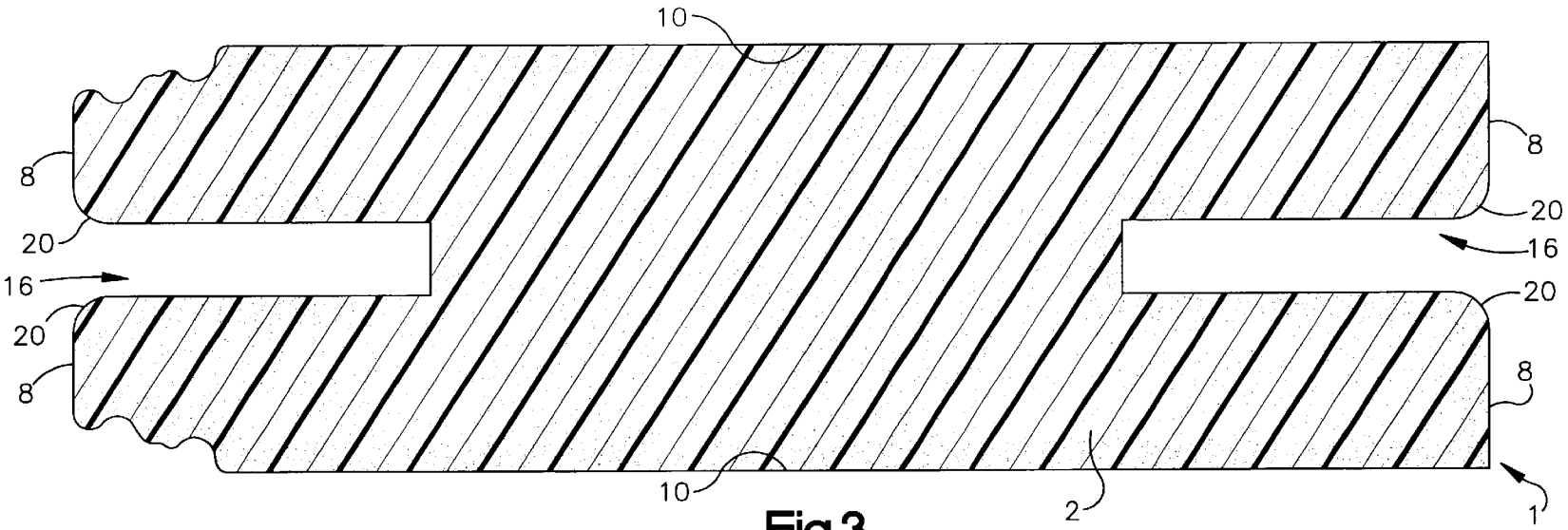
FIG. 3 is an end view of a panel of a preferred embodiment of the present invention illustrating the male connector configuration on one side and a female connector on the other side.

Referring to FIG. 3, the presently preferred embodiment is shown. Panel 1 has two male connectors 12 oppositely positioned and extending from one side surface 8 and two female connectors 14 oppositely positioned at an opposing side surface 8. Therefore, the two male connectors 12 at one side of a first panel 1 are configured to interact with the two female connectors 14 at another side of an adjacently positioned panel 1. In an alternate embodiment, however, there is suitably one male connector 12 and one female connector 14 at each side 8 of a panel 1. In such an embodiment, two male connectors 12 are at two opposing corners of panel 1 and two female connectors 14 are at the remaining two opposing corners of panel 1.

Figure 4:
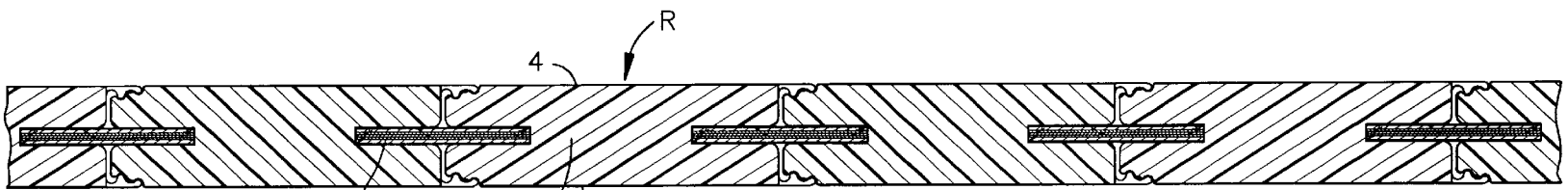
FIG. 4 is an end view of a panels system according to the present invention comprising interlocking panels of the present invention.

Referring to FIGS. 1–4, a building system having multiple panels as shown in FIG. 4 is constructed by connecting the panels 1 of the present invention together in the following manner. Two panels 1 are positioned adjacent to each other for connection by pressing or sliding the panels 1 together while the panels 1 are generally in the same plane. As the panels are pressed together, the male connectors 12 temporarily deflect externally so that the first male mating member 24 slides over the generally protruding female member 34 and nests in the first female mating member 32, which is configured to accept first male mating member 24. As this happens, the female generally protruding member 34 nests in the male generally curved member 26 and second male mating member 28 nests in second female mating member 38, which is configured to accept second male mating member 28. The nesting of first and second male mating members 24 and 28 in first and second female mating members 32 and 38 respectively connect the two adjacent panels 1 in a locking fashion. Ideally, first and second male mating members 24 and 28 would be in contact with first and second female mating members 32 and 38 throughout the majority of the curved members. However, due to lack of dimensional uniformity inherent in the manufacture of core material and the difficulty in machining precisely the sheets and connectors, it is almost impossible to guarantee that both the first and second male mating members 24 and 28 will both always be in contact with the majority of first and second female mating member 32 and 38 respectively.

In an embodiment having a spline 18, the panels 1 are connected in a manner similar to that described above. In addition, a spline 18 is placed in slot 16 of one of the panels 1 prior to pressing the panels 1 together. Optionally, the spline 18 is suitably fixed to panel 1 with adhesive as is commonly known in the art. However, the spline 18 is preferably inserted into slot 16 without adhesive so that the panels 1 may be pulled apart without damaging central core 2.

As described in the prior art, two of the major problems with insulating panels in the prior art are leakage and condensation. Referring again to FIG. 1, leakage, most often caused by rain, occurs whenever water is passed all the way from a roof side R, sheet 4, to a ceiling side C, sheet 6. Many of the prior art building panel connectors use caulk or sealant to prevent leakage. As previously described, caulk and sealant have disadvantages in that they tend to deteriorate over time, thus increasing the chance for leakage. Condensation is caused by temperature differences between a surface and its surrounding environment. When insulating panels are used as combination roof R and ceiling C members, the sheet 4 acting as roof member R is exposed to outside weather and the sheet 6 acting as ceiling member C is exposed to the temperature of an interior room, typically in the range of 65–75° F. A cold rain may fall and leak through the panel 1 so that the rain water rests on the interior surface of sheet 6. Even though the rain does not leak through sheet 6, the cold rain water will reduce the temperature of sheet 6. Oftentimes, such temperature reduction causes condensation on the exterior side of sheet 6, or the ceiling, of moisture from the air in the room. In extreme situations, such condensation builds up and drips into the room onto furniture and the floor.

The present invention provides a system designed to eliminate both leakage and condensation. Referring again to FIG. 1, if water from heavy rainfall penetrates panel 1 at the interface between a male connector 12 and a female connector 14 it will flow along female connector 14. If only a small amount of rainfall penetrates panel 1, it will collect in the channel 36 formed in the generally protruding member 34 of the female connector 14 and flow outwardly to the ends of the panel. If more water penetrates the panel than channel 36 can handle, the water will flow off female connector 14 and onto spline 18. The spline 18 will prevent the water from traveling any further toward sheet 6. As water collects on the spline 18, it will flow outwardly toward the ends of the panel, thus preventing further intrusion of water into the connected panels 1. Even in cases where water manages to travel beyond the spline 18, an optional second male extension member 30 preferably extends to the side surface 8 of a connecting panel 1, thus forming a gutter to collect any water that travels beyond the spline 18 so that the remaining water flow outwardly toward the ends of the panel 1. The panel 1 thus maintains multiple levels of protection from both leakage and condensation, combining the channel/gutter system of the male and female connectors with the protection of a spline.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What we claim is:

1. An insulated building panel configured for connection to a like adjacently positioned insulated panel to form a building system, said panel comprising:

a) a generally rectangular central core of insulating material having two major surfaces and two side surfaces;

b) sheets attached to said major surfaces of said central core;

c) at least one male connector integrally formed with one of said sheets at a side surface of said central core, said male connector comprising:

i) a generally convex curved first male mating member, ii) a generally convex curved second male mating member, and iii) a generally concave curved member between said first male mating member and said second male mating member, wherein said first male mating member, said curved member and said second male mating member form a generally sinusoidal shape;

d) at least one female connector integrally formed with one of said sheets at a side surface of said central core and configured to accept a male connector, said female connector comprising:

i) a generally concave curved first female mating member configured to accept said first male mating member, ii) a generally concave curved second female mating member configured to accept said second male mating member, and iii) a generally protruding member between said first female mating member and said second female mating member and further comprising a generally concave channel extending toward the center of the central core, to act as a flow channel for air and water;

wherein said at least one male connector is configured to temporarily deflect externally upon engaging a female connector when adjacent panels are connected together.

2. The insulated building panel of claim 1, wherein said male connector further comprises an extension member connected to said first male mating member which extends the male connector beyond said side surfaces of said central core.

3. The insulated building panel of claim 2, wherein said male connector further comprises a generally curved second extension member connected to said second male mating member which extends said male connector to said side surface.

4. The insulated building panel of claim 1 wherein said first male mating member is generally convex, said curved member is generally concave and said second male mating member is generally convex.

5. The insulated building panel of claim 1 wherein said sheets are metal.

6. The insulated building panel of claim 2 wherein said sheets are aluminum.

7. The insulated building panel of claim 1 wherein said sheets are relatively thin compared to the distance between said sheets.

8. The insulated building panel of claim 1 wherein the male mating members and female mating members extend inwardly toward the center of said central core.

9. The insulated building panel of claim 1 wherein said member of said female connector between said first female mating member and said second female mating member is further from the center of said core than is said first female mating member.

10. The insulated building panel of claim 1 wherein the second male and female mating members extend further toward the center of said core than do the first male and female mating members.

11. The insulated building panel of claim 1 wherein opposing sides of said central core each have one female connector and one male connector.

12. The insulated building panel of claim 1 wherein one side of said central core has two male connectors and the opposite side of said central core has two female connectors.

13. The insulated building panel of claim 1 wherein one side of said central core has a tongue and the opposite side of said central core has a groove configured to accept a tongue.

14. The insulated building panel of claim 1 wherein said central core further comprises a slot in a side surface formed between said sheets.

15. The insulated building panel of claim 13 wherein said slot is generally parallel to said sheets.

16. The insulated building panel of claim 13 wherein said slot runs along the entire length of the side surface.

17. The insulated building panel of claim 13 wherein said slot is configured to accept a spline.

18. The insulated building panel of claim 1 wherein said central core is constructed of an insulating material comprising at least one of polystyrene, urethane, and polyisocyanate.

19. An insulated building panel system comprising a plurality of insulated building panels adjacently positioned and connected together, each panel comprising:

a) a generally rectangular central core of insulating material having two major surfaces and two side surfaces;

b) sheets attached to said major surfaces of said central core;

c) at least one male connector integrally formed with one of said sheets at a side surface of said central core, said male connector comprising:

i) a generally convex curved first male mating member, ii) a generally convex curved second male mating member, and a generally concave curved member between said first male mating member and iii) said second male mating member;

d) at least one female connector integrally formed with one of said sheets at a side surface of said central core and configured to accept a male connector, said female connector comprising:

i) a generally concave curved first female mating member configured to accept said first male mating member, ii) a generally concave curved second female mating member configured to accept said second male mating member, and iii) a generally protruding member between said first female mating member and said second female mating member and further comprising a generally concave channel extending toward the center core, to act as a flow channel for air and water;

wherein said at least one male connector is configured to temporarily deflect externally upon engaging a female connector when adjacent panels are connected together.

20. The insulated building panel of claim 19 wherein said sheets are metal.

21. The insulated building panel of claim 19 wherein said sheets are aluminum.

22. The insulated building panel system of claim 19 wherein said protruding member of said female connector is further from the center of said core than is said first female mating member.

23. The insulated building panel system of claim 19 wherein the convex male mating members and concave female mating members extend inwardly toward the center of said central core.

24. The insulated building panel system of claim 19 wherein the second male and female mating members extend further toward the center of said core than do the first male and female mating members.

25. The insulated building panel system of claim 19 wherein opposing sides of said central core each have one female connector and one male connector.

26. The insulated building panel system of claim 19 wherein one side of said central core has two male connectors and the opposite side of said central core has two female connectors.

27. The insulated building panel system of claim 19 wherein one side of said central core has tongue and the opposite side of said central core has a groove configured to accept a tongue.

28. The insulated building panel system of claim 19 wherein said central core further comprises a slot in a side surface formed between said sheets.

29. The insulated building panel system of claim 28 wherein said slot is generally parallel to said sheets.

30. The insulated building panel system of claim 28 wherein said slot runs along the entire length of the side surface.

31. The insulated building panel system of claim 28 wherein said slot is configured to accept a spline.

32. The insulated building panel system of claim 31 further comprising a spline positioned in said slots of said panels.

33. The insulated building panel system of claim 32 wherein said spline is metal.

34. The insulated building panel system of claim 32 wherein said spline runs along the entire length of said side surface.

35. The insulated building panel system of claim 32 wherein said spline is wood.

36. The insulated building panel system of claim 19 wherein said central core is constructed of an insulating material comprising at least one of polystyrene, urethane, and polyisocyanate.

37. An insulated building panel system comprising at least one spline and a plurality of insulated building panels adjacently positioned and connected together, each panel comprising:

a) a generally rectangular central core of insulating material having two major surfaces and two side surfaces, the two side surfaces each having a slot extending toward the center of said core;

b) sheets attached to said major surfaces of said central core;

c) a male connector integrally formed with one of said sheets at a side surface of said central core, said male connector comprising a generally convex male mating member;

d) a female connector integrally formed with one of said sheets at a side surface of said central core and configured to accept a male connector, said female connector comprising a generally concave female mating member configured to accept said male mating member and wherein the female connector comprises a generally concave channel, to act as a flow channel for air and water;

wherein said male connector is configured to temporarily deflect externally upon engaging a female connector when adjacent panels are connected together and wherein said male connectors and female connectors of the adjacently positioned panels interact and said spline connects a first slot in a side surface of a first panel and a second slot in a side surface of a second panel.

38. The insulated building panel system of claim 33 wherein for every N number of panels there are N−1 number of splines.

39. The insulated building panel system of claim 33 wherein said male connector further comprises a second generally convex male mating member and a generally concave member between said first male mating member and said second male mating member.

40. The insulated building panel system of claim 33 wherein said female connector further comprises a second generally concave female mating member and a generally protruding member between said first female mating member and said second female mating member, and wherein the generally concave channel is formed on the generally protruding member.

41. The insulated building panel system of claim 37 wherein said central core is constructed of an insulating material comprising at least one of polystyrene, urethane, and polyisocyanate.

* * * * *